United States Patent [19]

Nachbur

[11] 4,196,260

[45] Apr. 1, 1980

[54] PROCESS FOR FLAMEPROOFING CELLULOSIC FIBROUS MATERIAL

[75] Inventor: Hermann Nachbur, Dornach, Switzerland

[73] Assignee: Ciba-Geigy Corporation, Ardsley, N.Y.

[21] Appl. No.: 882,011

[22] Filed: Feb. 28, 1978

[30] Foreign Application Priority Data

Mar. 3, 1977 [CH] Switzerland ..... 2666/77

[51] Int. Cl.[2] ..... B05D 3/02; B32B 23/08; B32B 27/42

[52] U.S. Cl. ..... 428/526; 8/116 P; 8/182; 260/29.2 N; 260/29.4 R; 427/381; 427/382; 427/393.3; 428/527; 428/921

[58] Field of Search ..... 427/381, 382, 390 D; 260/29.2 N, 29.4 R; 8/116 P, 182; 428/526, 527, 921

[56] References Cited

U.S. PATENT DOCUMENTS

| | | | |
|---|---|---|---|
| 2,781,281 | 2/1957 | Berger | 8/116 P |
| 3,746,572 | 7/1973 | Weil et al. | 427/390 X |
| 3,767,736 | 10/1973 | Burke | 260/950 |
| 4,059,532 | 11/1977 | Wachbar et al. | 252/8.1 |

FOREIGN PATENT DOCUMENTS

| | | | |
|---|---|---|---|
| 1371212 | 10/1974 | United Kingdom | 427/390 D |

*Primary Examiner*—Michael R. Lusignan
*Attorney, Agent, or Firm*—Prabodh I. Almaula

[57] ABSTRACT

A process is provided for flameproofing cellulosics in which an aqueous solution is applied thereto which contains (A) the phosphorinane of the formula

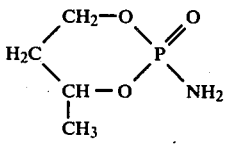

(B) an aminoplast precondensate, e.g. a methylolmelamine, and, optionally, (C) a latent acid catalyst, e.g. 2-amino-2-methyl-1-propanolchloride.

The cellulosics, e.g. textiles containing natural or regenerated cellulose, are then dried up to 100° C. and subjected to a heat treatment above 100° C., e.g. at 130° to 200° C.

11 Claims, No Drawings

PROCESS FOR FLAMEPROOFING CELLULOSIC FIBROUS MATERIAL

The present invention relates to a process for flameproofing cellulosic fibrous material, which comprises applying to said material an aqueous solution which contains at least (A) the phosphorinane of the formula

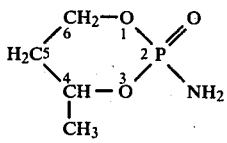

(1)

(B) an aminoplast precondensate, and optionally (C) a latent acid catalyst, drying the material and then subjecting it to a heat treatment.

The phosphorinane of the formula (1) is in itself known or it can be prepared by methods which are in themselves known, for example by reaction of n-butane-1,3-diol with phosphoroxy chloride and further reaction of the resulting 2-oxo-2-chloro-1,3,2-dioxa-4-methylphosphorinane with ammonia to give the phosphorinane of the formula (1). In another method it is possible to transesterify a dialkyl hydrogen phosphite with n-butane-1,3-diol and to react the resulting 2-oxo-1,3,2-dioxa-4-methylphosphorinane with ammonia in the presence of carbon tetrachloride to give the phosphorinane of the formula (1) (cf. B. N. Wilson, I. Gordon and R. R. Hindersinn in Ind. Eng. Chem., Prod. Res. Develop. 13(1), 85–89 (1974); R. F. Atherton, H. T. Openshaw and A. R. Todd in J. Chem. Soc., 660–662 (1945) and A. A. Oswald in Can. J. Chem. 37, 1498–1504 (1959).

In addition to the phosphorinane of the formula (1), the aqueous solution which is used in the process of the invention always contains at least one aminoplast precondensate.

Aminoplast precondensates are in general known as adducts of formaldehyde with methylolatable nitrogen compounds. As methylolatable nitrogen compounds there may be mentioned: 1,3,5-aminotriazines, such as N-substituted melamines, for example N-methylmelamine or N-butylmelamine, and triazones as well as guanamines, for example benzoguanamines, acetoguanamines or also diguanamines.

Other suitable methylolatable nitrogen compounds are: cyanamide, acrylamide, alkyl- or arylureas and alkyl- or arylthioureas, alkylene ureas or diureas, for example urea, thiourea, urones, ethylene urea, propylene urea, acetylene diurea or especially 4,5-dihydroxyimidazolidone-2 and derivatives thereof, for example 4,5-dihydroxyimidazolidone-2 which is substituted in the 4-position at the hydroxyl group by the radical $—CH_2CH_2—CO—NH—CH_2OH$. Preferably, the methylol compounds of a urea, of an ethylene urea or especially of melamine, are used as component (B).

Useful products are obtained in general from highly methylolated, but especially also lower methylolated, compounds, for example etherified or non-etherified methylolmelamines, such as di- or trimethylolmelamine or the corresponding ethers thereof, which are preferred as component (B). Suitable aminoplast precondensates are both chiefly monomolecular and higher precondensed aminoplasts.

If the ethers of these aminoplast precondensates are used, water-soluble ethers of methanol are in particular suitable. To be mentioned especially as examples of such ethers are pentamethylolmelamine dimethyl ether or trimethylolmelamine dimethyl ether.

In the aqueous solutions of the present invention it can be advantageous to use a curing catalyst for speeding up the curing of components (A) and (B) on the fibrous material, for example a latent acid catalyst as additional, optional component (C).

Suitable latent acid catalysts as component (C) are salts of a strong inorganic acid with an inorganic weak base or preferably salts of a hydroxyalkylamine containing 1 to 4 carbon atoms with a strong inorganic acid. To be mentioned as examples of salts of strong inorganic acids with weak inorganic bases are ammonium chloride, ammonium dihydrogen orthophosphate, magnesium chloride, zinc-nitrate, and, as examples of salts of a hydroxyalkylamine with a strong inorganic acid, 2-amino-2-methyl-1-propanol-phosphate, 2-amino-2-methyl-1-propanol-sulphate and especially 2-amino-2-methyl-1-propanol-chloride.

If necessary, the aqueous solutions can be adjusted to the desired pH value with inorganic acids, for example hydrochloric acid, sulphuric acid, preferably phosphoric acid, or with inorganic bases, for example an aqueous potassium hydroxide or especially sodium hydroxide solution.

It can also be advantageous to add buffer substances, such as sodium bicarbonate, di- and trisodium phosphate or triethanolamine.

A further, often advantageous ingredient to be mentioned is a softening agent, for example an aqueous polysiloxane emulsion or ethylene emulsion or ethylene copolymer emulsion, or especially the fabric softeners described in British Pat. No. 1,453,296, for example the imidazole of the formula

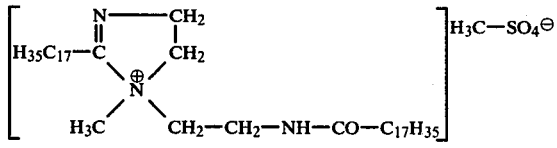

(2)

or highly etherified melamine/formaldehyde condensation products which are modified with fatty acid alkanolamides.

The addition of wetting agents, for example of condensation products of alkylated phenols with ethylene oxide, can also be advantageous.

The content of component (A) in the aqueous solutions is desirably such that, based on the weight of the material to be treated, 10 to 40% of the phosphorinane of the formula (1) is applied. In this connection, regard is to be had to the fact that the cellulosic fibrous materials, especially the commercially available textiles of natural or regenerated cellulose are able to take up between 50 and 120 percent by weight of the aqueous solution used in the present invention.

The amount of ingredient used, if appropriate, to adjust the pH value from 5 to 7.5, depends on the chosen value and on the nature of the ingredient.

If further ingredients are added to the solution, such as a latent acid catalyst, a fabric softener and/or a wetting agent of the indicated kind, such addition is advantageously made in small amounts, for example 1 to 10%, based on the weight of the phosphorinane of the formula (1).

In a preferred embodiment of the invention, the aqueous solutions for flameproofing cellulosic fibrous material contain 100 to 400 g/l, preferably 150 to 300 g/l, of the phosphorinane of the formula (1) as component (A), 50 to 300 g/l, preferably 100 to 250 g/l, of at least one aminoplast precondensate as component (B), and 0 to 80 g/l, preferably 2 to 40 g/l, of a latent acid catalyst as optional component (C) and/or of at least one of the ingredients mentioned above.

The solutions are applied to the cellulosic fibrous materials in a manner which is in itself known. It is preferable to use piece goods, which are impregnated on a padder of conventional construction which is charged with the solution at room temperature.

The impregnated fabric must then be dried, and the drying is desirably carried out at temperatures up to 100° C. The fabric is then subjected to a dry heat treatment at temperatures above 100° C., for example between 130° and 200° C. and preferably between 150° and 180° C. The higher the temperature, the shorter the treatment can be. The duration of the heat treatment is for example 2 to 6 minutes at temperatures between 150° and 180° C.

A washing-off with an acid acceptor, preferably with an aqueous sodium carbonate solution, for example at 40° C. to boiling temperature and for 3 to 10 minutes, is advantageous if the reaction medium is strongly acid.

The fibrous material which is flameproofed by the process of the invention contains natural cellulose, such as linen, hemp, sisal, ramie, cotton and/or regenerated cellulose, for example rayon, staple fibres or filament viscose.

In addition to pure cellulose fibres, blends with man-made synthetic fibres are suitable, in which the cellulose content is at least 75, preferably 80 to 90, percent by weight of the blend. Examples of suitable man-made synthetic fibres are polyacrylonitrile, acrylonitrile copolymers, preferably polyamide and especially polyester.

The acrylonitrile content of acrylonitrile copolymers is desirably at least 50 percent by weight and preferably at least 85 percent by weight of the copolymer. The copolymers are in particular those in whose production other vinyl compounds, for example vinyl chloride, vinylidene chloride, methacrylates, acrylamide or styrenesulphonic acids, have been used as comonomers.

Preferred polyamide fibres are for example those of poly-2-caprolactam, polyhexylmethylenediamine adipate or poly-ω-aminoundecanoic acid.

The further preferred polyester fibres are derived in particular from terephthalic acid, for example from poly (ethylene glycol terephthalate) or poly(1,4-cyclohexylenedimethylene terephthalate). Polyester fibres are described for example in U.S. Pat. No. 2,465,319 or No. 2,901,446.

The fibres consisting only of cellulose are preferred to the polyacrylonitrile or acrylonitrile copolymer/cellulose, polyamide/cellulose or polyester/cellulose blends. Cotton fabric is preferred.

The fibrous materials comprise for example wood, paper or preferably textiles in any stage of processing, such as filaments, yarns, spools, webs, knitted or woven fabrics or finished garment fabrics. Cotton fabrics in particular can be especially well flameproofed by the process of the invention.

The flameproof finishes obtained by the present process have, as already indicated, the advantage of being substantially retained even after repeated washing or dry cleaning. This is also the case in low rates of application, i.e. when small amounts of phosphorous are applied to the finished material. The flameproof finishes do not cause any unacceptable reduction of the textile-mechanical properties of the treated material. This applies in particular to the handle of the finished textiles. In addition, the finished textiles remain wrinkle- and shrink-resistant even after repeated washing. A further advantage of the process of the present invention consists in the fact that the treated material does not yellow when flameproofing fibrous material with the phosphorinane of the formula (1).

The good stability over several hours of the aqueous solutions used in the process is also advantageous.

The invention is illustrated by the following Example, in which the parts and percentages are by weight.

EXAMPLE

A cotton fabric (surface weight: 150 g/m$^2$) is padded with the aqueous liquor of the composition indicated in the following table. The liquor pick-up is 80%. The fabric is dried for 30 minutes at 80° C. and then cured for 4½ minutes at 160° C. A portion of the fabric is then given a washing-off at 95° C. for 5 minutes in a solution which contains, in a liter of water, 4 g of anhydrous sodium carbonate and 1 g of a reaction product of 1 mole of 4-nonylphenol and 9 moles of ethylene oxide, then rinsed and dried.

A further portion of this fabric is then washed up to 10 times for 60 minutes in a solution of 95° C. which contains 5 g/l of synthetic detergent in accordance with SNV 198 861.

The individual pieces of fabric are then tested for their flame-resistance (vertical test in accordance with DIN 53906, application time: 6 seconds). The results of this test are also reported in the table.

In addition, the handle of the fabrics is tested manually after the washing-off and evaluated in accordance with the following rating:

Table

| | | untreated | treated |
|---|---|---|---|
| liquor consitutents in g/l | | | |
| phosphorinane of the formula (1) (phosphorus content: 20.5%) | | | 183 |
| di-trimethylolmelamine (75%) (nitrogen content: 41.5%) | | | 200 |
| 2-amino-2-methyl-1-propanol-hydrochloride (35%) | | | 40 |
| g P/kg of fabric | | | 30 |
| degree of fixation in % | | | 53 |
| flame-resistance | | | |
| AFT = after-flame time in seconds | | | |
| CL = char length in cm | | | |
| before the washing-off | AFT | burns | 0 |
| | CL | | 10 |
| after the washing-off | AFT | burns | 0 |
| | CL | | 12 |
| after 10 washes | AFT | burns | 0 |
| | CL | | 13 |
| handle | | 0 | 1 |

O = unchanged
1 = a trace stiffer than O
2 = somewhat stiffer than O
3 = stiff

-continued

| |
|---|
| 4 = very stiff |

What is claimed is:

1. A process for flameproofing cellulosic fibrous material, which comprises applying to said material an aqueous solution which contains an effective amount of (A) 100 to 400 g/l of the phosphorinane of the formula

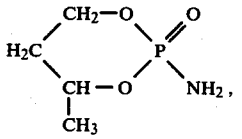

and (B) 50 to 300 g/l of an aminoplast precondensate, drying the fibrous material and then subjecting it to a a heat treatment.

2. A process according to claim 1, in which the aqueous solution contains urea, ethylene urea or melamine, which are methylolated or their etherified derivatives, as component (B).

3. A process according to claim 1, in which the aqueous solution contains a methylolmelamine or an etherified methylolmelamine as component (B).

4. A process according to claim 1, in which the material is dried at temperatures up to 100° C. and subsequently subjected to a heat treatment at 130° to 200° C.

5. A process according to claim 1, which process comprises flameproofing a textile material containing natural or regenerated cellulose, as the cellulosic fibrous material.

6. A fibrous material provided with a flameproof finish according to claim 1.

7. An aqueous solution for carrying out the process according to claim 1 which contains an effective amount of (A) 100 to 400 g/l of the phosphorinane of the formula

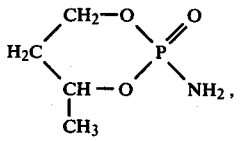

and (B) 50 to 300 g/l of an aminoplast precondensate.

8. A process of claim 1, wherein the aqueous solution further contains (c) 0 to 80 g/l of a latent acid catalyst.

9. The aqueous solution of claim 7, which further contains (C) 0 to 80 g/l of a latent acid catalyst.

10. A process according to claim 8, in which the aqueous solution contains a salt of a hydroxylamine with 1 to 4 carbon atoms with a strong organic acid as component (C).

11. A process according to claim 10, in which the aqueous solution contains 2-amino-2-methyl-1-propanol-phosphate, -sulphate or -chloride as component (C).

* * * * *